United States Patent [19]
Cavallari
[11] 4,433,927
[45] Feb. 28, 1984

[54] ELECTROMAGNET ASSEMBLY FOR MOSAIC PRINTING HEAD AND RELATED MANUFACTURING METHOD

[75] Inventor: Pier G. Cavallari, Novara, Italy

[73] Assignee: Honeywell Information Systems Italia, Caluso, Italy

[21] Appl. No.: 350,539

[22] Filed: Feb. 19, 1982

[30] Foreign Application Priority Data

Feb. 25, 1981 [IT] Italy ..... 19958 A/81

[51] Int. Cl.³ ..... B41J 3/12
[52] U.S. Cl. ..... 400/124; 101/93.05
[58] Field of Search ..... 400/124; 101/93.05

[56] References Cited

U.S. PATENT DOCUMENTS 3,584,575 6/1971 Distl ..... 400/124 X
3,929,214 12/1975 Hebert ..... 400/124
4,049,107 9/1977 Murat ..... 400/124
4,244,658 1/1981 Mori ..... 400/124

*Primary Examiner*—Paul T. Sewell
*Attorney, Agent, or Firm*—Nicholas Prasinos

[57] ABSTRACT

An electromagnet assembly for a matrix printing head which can be automatically assembled and a manufacturing process for automatically assembly said electromagnet assembly.

3 Claims, 5 Drawing Figures

ELECTROMAGNET ASSEMBLY FOR MOSAIC PRINTING HEAD AND RELATED MANUFACTURING METHOD

BACKGROUND OF THE INVENTION

1. Field of the Invention

The present invention relates to an electromagnetic assembly for mosaic printing head and a related manufacturing method.

2. Description of the Prior Art

It is known that the mosaic serial printers have been widely used as console printers in data processing systems as well as computer printing terminals. Such printers are required to have high reliability, low cost and high performances (speed, printing quality). A considerable portion of the cost of these printers is determined by the cost of the printing heads which require precise operations of assembling and setting. Reliability, printing speed and printing quality of such printers essentially depends on the printing heads too. Therefore, considerable attention of serial printer manufacturers is devoted to the study, the development and the improvement of the print heads. This is confirmed by the large number of patents and patent applications relating to the design and manufacturing details of such print heads.

According to the most recent embodiments, the print heads include a plurality of electromagnets. A movable armature coupled to each electromagnet controls the axial movement of a needle, so that the needle causes an impression on a printing support via an inked ribbon. A typical example of such printing heads is given by U.S. Pat. No. 3,889,793.

In order to facilitate the assembling and setting operations, the design of modern printing heads has evolved so that they may be formed by functional assemblies which may be easily joined. An assembly usually comprises the needles and the related guides and support elements (needle guide assembly). Another assembly comprises the electromagnets and their related movable armatures with their related clamping and positioning means and their related devices for adjusting the movable armature stroke (electromagnetic actuator assembly). An example of printing heads arranged according to such criteria is given by U.S. Pat. No. 4,260,270.

In these printing heads, the electromagnetic actuator assembly includes a ring-shaped support element on which a plurality of magnetic cores, generally constituted by a yoke and two columns, is fixed. A winding is arranged around a column of each core and provides the magnetization of the magnetic circuit constituted by the core and by a movable armature closing the magnetic circuit. The several armatures, each one coupled to a core, are properly positioned by a suitable retaining element. The electromagnet support element and the cores with their respective windings form a unitary set which we shall call the electromagnet assembly. Such electromagnet assembly, together with the movable armatures and the respective retaining and positioning devices, forms the electromagnetic actuator assembly. As is known, the printing head is mounted on a movable carriage of the printer. Therefore, the energization of the several windings is obtained by connecting their terminals to a feeding electronic circuit placed inside the printer through a flexible cable having several conducting leads. Connection to the cable can be direct or through connectors. The connection of the several windings to the flexible cable or to the connector is expensive because it requires a manual connection operation. Moreover, it is delicate and is responsible for frequent failures which are due to the printing head and carriage vibrations and reduce the equipment reliability. The mounting of the magnetic cores is critical too, although obtained by shrinking of the magnetic core sheets into suitable slots or by calking, they are responsible for possible breakage. Attempts have been made to obviate these inconveniences by partially encasing the windings and the cores in thermoplastic resins poured on them. This sticks the electromagnet support elements, the magnetic cores and the windings together. The above arrangement is, for example, described in U.S. Pat. No. 4,049,107. But such arrangement avoids only in part the cited inconvenience because the connection of the windings remains a critical element and adds an operation and therefore a cost to the manufacturing process of the printing head. The present invention overcomes such disadvantages.

OBJECTS OF THE INVENTION

It is a primary object of the invention to provide an electromagnetic assembly comprised of a printed circuit board on which the winding ends of the several electromagnets and a connecting socket are soldered.

It is a further object of the invention to encapsulate the magnetic cores and related windings, the printed circuit board (with the sole exception of the printed circuit board portion where the connecting socket is mounted) in hardening plastic material so as to form a unitary assembly where the support function is carried out by the hardening plastic material itself.

SUMMARY OF THE INVENTION

The foregoing objects are achieved according to a preferred embodiment of the invention by an automated manufacturing process comprising the following steps:

(1) preparation of the windings on reels according to conventional automated methods;
(2) preparation of the cores;
(3) insertion of the cores into the reels;
(4) automatic soldering of the windings on the printed circuit;
(5) placement of the printed circuit into a mold; and,
(6) encapsulating by plastic molding of the whole set.

In this way the necessity of assembling the electromagnets on a mechanical support is avoided, and the mechanical support is provided by the plastic casing.

The advantages obtained are clear: the manufacturing process is simplified and fit for performance by means of automated operations with consequent cost reduction; the resulting product provides high reliability of the electric connections and the core mounting.

BRIEF DESCRIPTION OF THE DRAWINGS

These and other advantages and features of the invention will appear more clearly from the following description of a preferred embodiment of the invention and from the related drawings where.

DETAILED DESCRIPTION OF THE PREFERRED EMBODIMENTS

Figure 1:
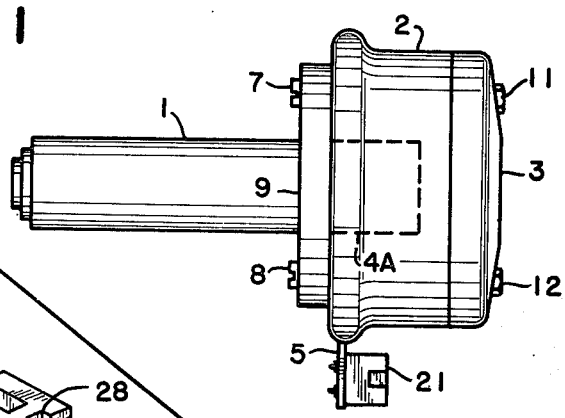
FIG. 1 shows in side view a printing head comprising an electromagnet assembly according to the present invention.

Referring to FIG. 1, there is shown a printing head including an electromagnetic assembly according to the invention. The printing head is comprised of three separate elements: a mechanical assembly 1 which supports and guides the needles, an electromagnet assembly 2 and an element 3 which retains the electromagnetic armatures and adjusts their position. The needle support and guiding assembly 1 may be constituted in conventional form as described in the already cited U.S. Pat. No. 4,260,270 or in the U.S. Pat. No. 4,004,673. Because it is beyond the scope of the invention and is well known to the people skilled in the art, any further description of this support and guide assembly is omitted.

Needle support and guiding assembly 1 is fixed to the molded electromagnet assembly 2 by means of a plurality of screws (in FIG. 1 the heads 7 and 8 of two of these screws are visible). Assembly 1 extends into electromagnet assembly 2 by means of an appendix (shown in dotted lines in FIG. 1 and referenced by numeral 4A). Such appendix, having a preferable cylindrical external shape, is engaged into a corresponding opening of electromagnetic assembly 2. Electromagnetic assembly 2 is a unitary element approximately shaped as a circular ring with a rectangular section. The electromagnetic assembly 2 will be described in more detail, as will be described a process for manufacturing such assembly.

A torgue 5 extends from electromagnet assembly 2. Such tongue is part of a printed circuit whose shape and function will be better seen infra. A connecting socket 21 is soldered on it. Each pair of pins of socket 21 is connected to the two terminals of each electromagnet winding. A retaining and adjusting element 3 is further coupled to electromagnetic assembly 2 by means of the same screws used for coupling the needle guide assembly 1. In FIG. 1, two stop nuts 11 and 12, screwed on two of such screws, are visible.

Element 3 has the function of supporting and of positioning the armatures in the plane of the related magnetic circuit; besides, it has the function of adjusting the air gap of the electromagnetic structures and to perform a cushioning action when an armature moves from the attraction state to the release state. Numerous embodiments of the retaining and adjusting elements exist in the prior art, as for example the one described in the already cited U.S. Pat. No. 4,049,107; accordingly, any further description is omitted.

Figure 2:
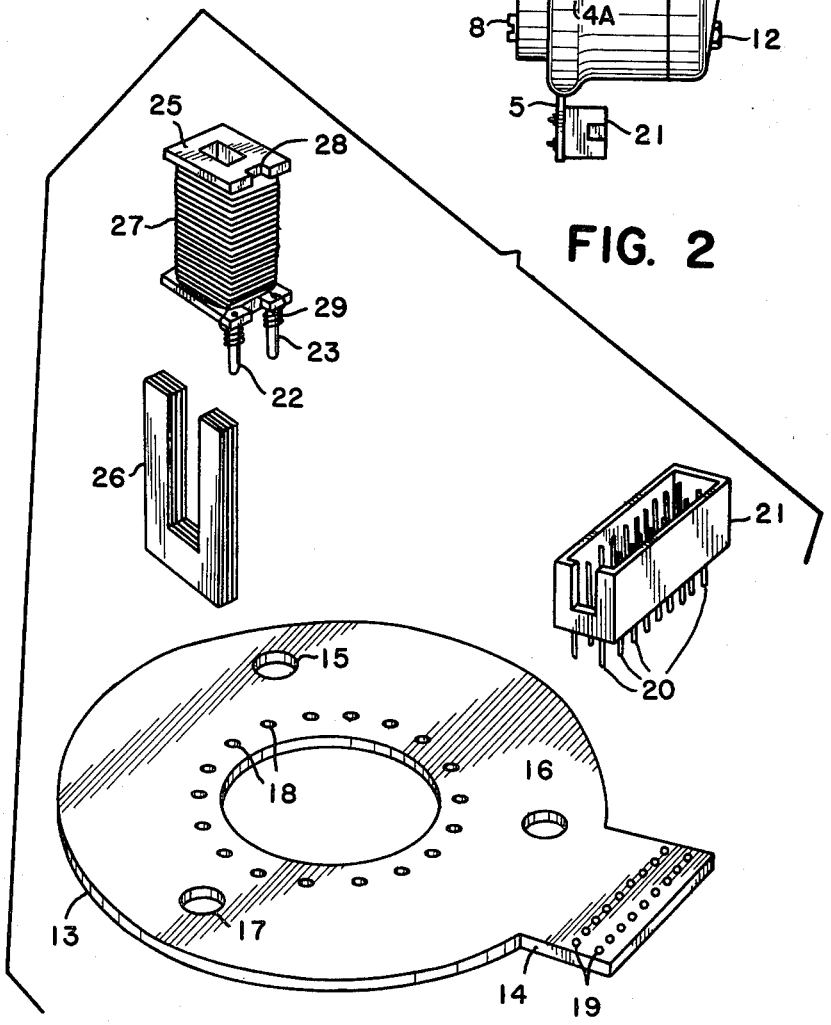
FIG. 2 shows in exploded perspective view the several elements forming the electromagnet assembly of the invention.

FIG. 2 shows in exploded perspective view the elements forming the electromagnet assembly 2. Assembly 2 comprises a ring-shaped printed circuit board 13 provided with an appendix 14 (corresponding to tongue 5 of FIG. 1) and three openings 15, 16 and 17, of suitable diameter radially arranged and intended for insertion of three screws (like 7 and 8 of FIG. 1) clamping needle guide assembly 1 and retaining element 3 to electromagnet assembly 2. In addition, the printed circuit board 13 has a plurality of hole pairs (in FIG. 2 nine pairs are shown, a pair of which is identified by reference numeral 18). These hole pairs are radially arranged near the inner edge of the ring and are intended to receive the connection pins of electric components. A corresponding plurality of hole pairs is made on appendix 14, the holes of each pair being arranged according to parallel lines (in FIG. 2 only a pair is identified by reference numeral 19).

The printed circuit board supports, on the side not visible in FIG. 2, a plurality of soldering pads, one for each of the holes such as those for pairs 18 and 19. Each pad corresponding to a hole in tongue 14 is electrically connected to a pad corresponding to one of the holes like those of pair 18. Pins 20 of connection socket 21 are inserted into the holes like those of pair 19 and soldered to the corresponding pads. Printed circuit board 13 provides the connection of the windings of the electromagnet assembly to connection socket 21, and further provides the several individual electromagnets with a temporary mechanical support. Each electromagnet of assembly 2 is constituted by a separate individual core on which a coil is wound. For the sake of clarity, only one core 26 and only one coil 27 are shown in FIG. 2.

Each core 26 comprises a stack of U-shaped magnetic sheets having two magnetic columns joined by a yoke. Each coil 27 comprises a shell 25 made of insulating material and is provided with a central opening intended to receive a core column. Two conductive pins 22 and 23 are fixed to the lower flange of each winding. Each of the two windings having flanges is provided with a reference groove 28 and 29 respectively; the function of such grooves will be described infra.

The enameled wire forming the coil is wound on the reel. The wire ends, from which the insulation coating has been previously removed, are wrapped around pins 22 and 23 and then soldered thereto. By engaging coil 27 on a column of core 26, an electromagnet is obtained. Such electromagnet can be mounted on printed circuit board 13 as any electric component by inserting pins 22 and 23 into holes 18. This operation can be easily performed by automated machines. Pins 22 and 23 are then welded to the conductive pads corresponding to holes 18.

Although in FIG. 2 only one electromagnet is shown, it is clear that the printed circuit board is intended to receive a plurality of electromagnets (nine in FIG. 2 which are anchored to the printed circuit by soldering of the electric connection pins). This anchorage does not obviously suffice to provide the required stiffness to the assembly, but it is is suitable for allowing its handling in the manufacturing process as a unitary element. The element obtained in this manner is placed into a mold of suitable shape into which a hardening plastic resin is poured or injected. The plastic resin is then hardened so as to steadily and irremovably encapsulate the elements constituting the assembly as an insert in a plastic unitary block.

Figure 3:
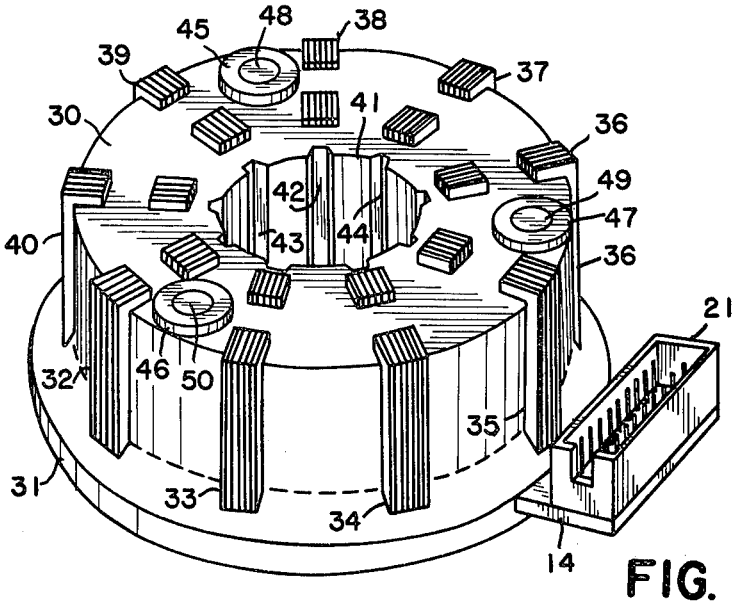
FIGS. 3 and 4 show in perspective view the electromagnet assembly of the present invention.
Figure 4:
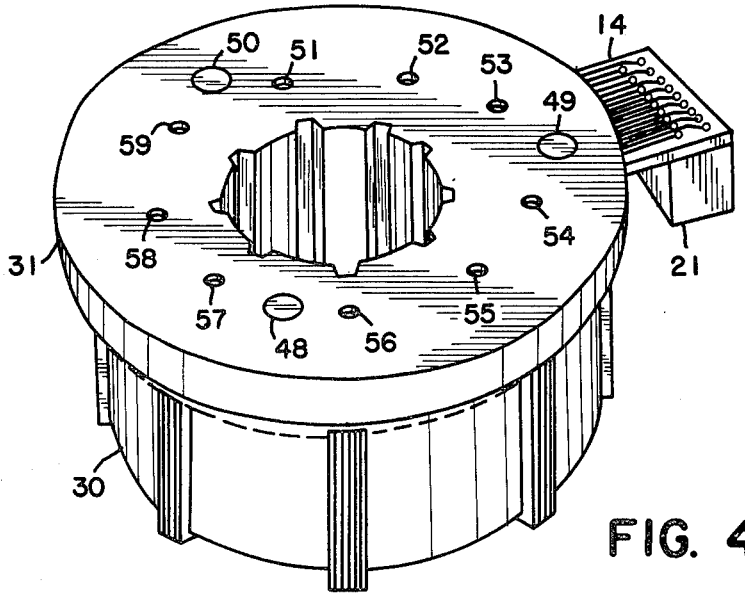

FIGS. 3 and 4 show in perspective view the electromagnet assembly according to two different orientations so that the electromagnets are seen above and below the printed circuit respectively. Such figures clearly show the shape and the detail features of the unitary electromagnet assembly resulting from the encapsulating by resin. Also, the corresponding characteristic of the mold used for the encapsulating may be deduced from FIGS. 3 and 4.

The encapsulating plastic body is essentially shaped as a cylinder 30 provided with a central cylindrical opening 41 and with a toroidal neck 31 having a diameter somewhat greater than the one of cylinder 30. Printed circuit appendix 14, on which connection socket 21 is soldered, laterally protrudes out of neck 31.

It may be clearly seen in FIG. 3 that the cores of the electromagnets are radially and uniformly arranged into body 30. The columns, on which the windings are inserted, are inwardly arranged and the columns without windings are outwardly arranged around the cylindrical periphery of body 30. In particular, the outwardly located columns, from 32 to 40, protrude from the plastic body. This means that the mold used for the plastic body molding is provided at the outward cylindrical periphery and have grooves for housing the core portions which protrude from the plastic body. In other words, the mold is provided with peripheral guiding grooves which assure the correct transversal and angular positioning into the mold of the assembly constituted by the printed circuit board and by the several electromagnets mounted thereon.

The protrusion from plastic body 30 of a portion of the external columns additionally provides a more effective dissipation of the heat which develops from the magnetic fields which are induced in such magnetic circuits when the printing head is working.

Central cylindrical opening 41 has a plurality of axial grooves 42, 43, 44 . . . radially arranged in uniform way, each one radially aligned with an electromagnet. This means that the mold is provided with a massive central part on the cylindrical periphery on which there are several axial teeth corresponding to grooves 42, 43, 44 . . . . Such teeth are intended to engage grooves 28 and 29 present on the reel flanges when the assembly constituted by the printed circuit board and by the electromagnets is inserted into the mold. So these teeth provide a further reference surface which assure the correct transversel and angular positioning of the assembly into the mold.

The upper face of cylindrical body 30, as it may be seen in FIG. 3, is a bit lowered as to the column height except for three protruding collars 45, and 46 and 47 arranged round three axial openings 48, 49 and 50 of suitable diameter which cross cylindrical body 30 and neck 31. Axial openings 48, 49 and 50 match with holes 15, 16 and 17 of printed circuit 13 of FIG. 2 and are intended to house the screws (7 and 8 of FIG. 1) which couple the needle guide assembly 1 to electromagnet assembly 2.

It is evident that such axial openings correspond to three parallel (or preferably tapered) pins present in the mold. The fact that the columns of the magnetic circuits slightly protrude with their heads from the encapsulating plastic implies that the mold is provided with suitable (preferably tapered) housings for such heads. These housings too contribute to the correct transversel and angular positioning of the electromagnets into the mold before molding. The correct axial positioning of the printed circuit board and of the electromagnets is assured by a dolly. In fact it is to be noted, by considering FIG. 4, that the upper face (in FIG. 4) of the electromagnetic assembly shows, besides axial openings 48, 49 and 50, a plurality of tapered cavities 51, . . . , 59 radially arranged and penetrating into the plastic down to to the depth of the printed circuit. Such cavities are obviously the result of the presence on the dolly of pressure pins on which the printed circuit with the electromagnets has been inserted into the mold, and which press the printed circuit against the mold bottom, thus assuring the correct axial positioning. An electromagnet assembly like the one above described is obtained through a completely automated manufacturing process.

Figure 5:
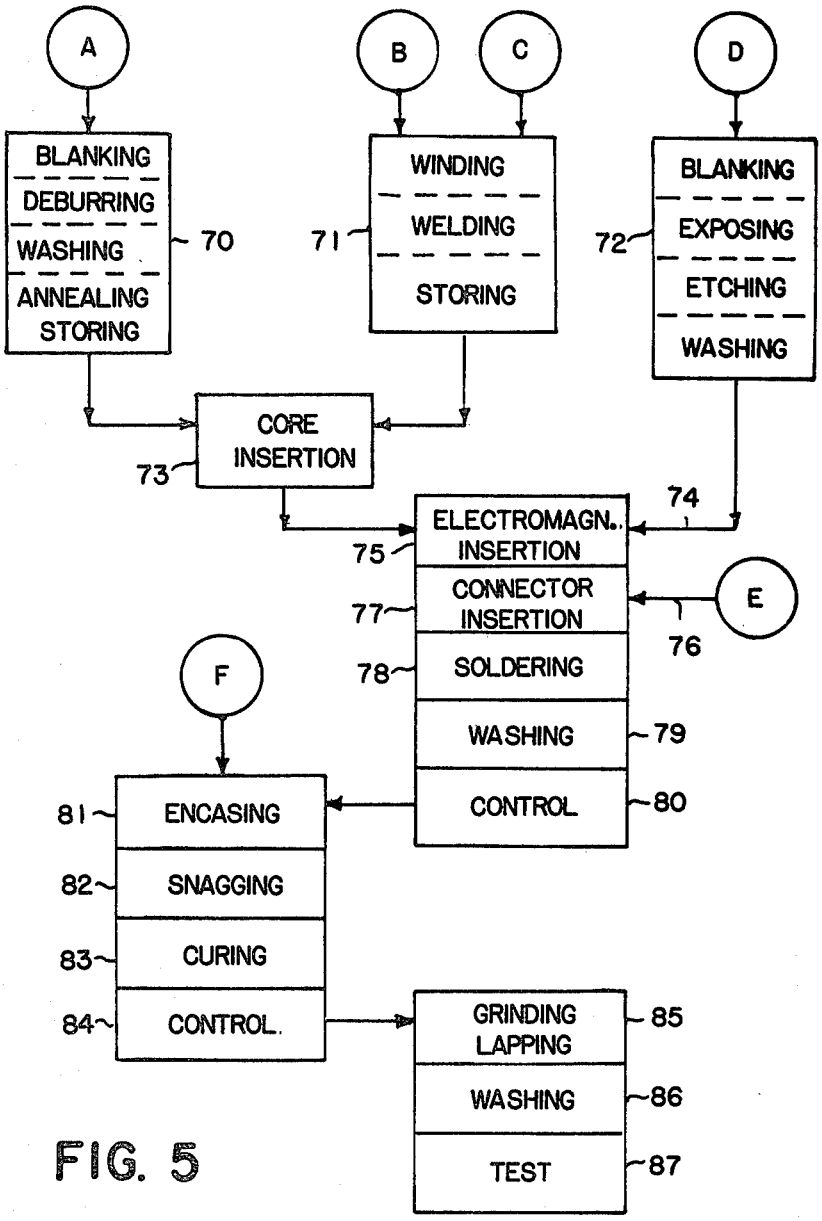
FIG. 5 shows the flow diagram of the manufacturing process used for obtaining the electromagnet assembly of the invention.

FIG. 5 shows in flow diagram such process. The initial raw materials are:

(a) magnetic iron in sheets or band;
(b) enameled wire;
(c) insulating material reels (like 25);
(d) copper clad substrate for printed circuits;
(e) connectors;
(f) plastic material or resin.

The magnetic iron sheet is first blanked in the desired shape. The magnetic sheets are then deburred, washed, annealed and stored into a stick loader all with equal orientation. The above well known operations, carried out by production equipment available on the market, are shown by block 70 and constitute a preliminary step of the process of the invention.

The enameled wire and the reels feed an automatic coil winder 71 which provides the wire winding on the reel and obtains the desired turn number in order to weld the wire terminals to the reel pins (22 and 23 of FIG. 2). Additionally, it provides the oriented storing of the coils so obtained into stick loaders. These well known operations carried out by automatic equipment available on the market, constitute a preliminary step of the process of the invention.

Similarly the copper clad substrate for printed circuits is subjected to the known operations of blanking, photoengraving and washing and the printed circuit boards so otained are stored into loaders (block 72 of FIG. 5). At this point the productive process constituting the specific object of the invention is started. The magnetic sheets are drawn in stacks from the stick loaders by an automatic machine is provided with a drawing box. The automatic machine receives the already prepared coils and inserts a core column into a coil (block 73). The electromagnets thus formed feed an automatic machine able to insert components on printed circuit. Such a machine receives from a path 74 the printed circuit boards and inserts thereon the desired number of electromagnets (block 75). The same machine receives from a path 76 the connectors (21 of FIG. 2) and, in a second station, provides for the connector insertion on printed circuit board (block 77).

The printed circuit artworks feed a wave soldering station where the electromagnets and the connector, held in position by a suitable fixture, are soldered to the printed circuit board (block 78). Afterwards, the sets so formed cross a washing and subsequent drying station (block 79) and enter in a control station 80 where soldering operation is monitored through automatic conductivity tests for connection quality and through automatic insulation tests for detection of possible shorts. At this point the set is ready to be encapsulated and is provided to a molding machine fed by grains or preformed granules of plastic material (f).

Several plastic material may be used such as epoxy resins, filled with quarz powder, or polyamide resins, filled with fiber glass too, are the most suitable materials because of their insulating property, mechanical strength and high dimensional stability.

The molding machine provides for the automatic insertions of the sets into the mold and for their encapsulating (block 81). Then the encapsulated sets cross a snagging station (block 82) where possible overpresses are removed and a curing station (block 83) where the polymerization and the cooling of the plastic material is completed. At this point it may be said that the production process has been completed. Test operation for completeness of the encapsulating and the absence of blisters and cracks may then be performed which may be automatic with respect to the measures of the insulation and conductivity, and visual with respect to the inspection of the encapsulated assembly.

This test operation is followed by the grinding and lapping of the electromagnet column heads so as to assure that such heads are perfectly coplanar and that the ground plane is parallel to the base plane, that is to the opposite plane of the electromagnet assembly (block 85). This operation is followed by washing in order to eliminate the powders resulting from the lapping operation (block 86). Finally, a further test operation may be carried out (block 87). Afterwards, the electromagnet assembly so obtained is ready for assembly in a printing head is coupling it to a needle guide assembly and to an armature retaining element.

In conclusion, the electromagnet assembly of the present invention may be obtained through a completely automated production process, except for a few operations of visual inspection, and therefore it is particularly inexpensive.

It is clear that numerous shape changes may be made to the described electromagnet assembly without departing from the scope of the invention.

What is claimed is:

1. An electromagnet assembly for mosaic printing head comprising:

(a) a plurality of separate electromagnets, each one formed by a separate individual core and at least a winding coupled to said core, said winding being supported by a reel provided with electrical connecting pins;

(b) a printed circuit board to which said plurality of electromagnets is fixed by soldering of said pins to said printed circuit board, with exclusion of any other means fixing together said electromagnets;

(c) connection means through which said printed circuit board may be connected to an external electric circuit; and (d) insulating plastic means (enclosing) steadily encapsulating as an insert said printed circuit board and said plurality of electromagnets, except said connection means, in a unitary block, said plastic means and said printed circuit board being in lieu of any other mechanical support of said plurality of electromagnets.

2. Electromagnet assembly as recited in claim 1 wherein said insulating plastic means encapsulate only partially the cores of said electromagnets.

3. An electromagnet assembly as recited in claim 2 wherein said cores comprise at least two columns, one of which is without winding and is partially encapsulated by said insulating plastic means.

* * * * *